US008746610B2

(12) United States Patent
Iwata

(10) Patent No.: US 8,746,610 B2
(45) Date of Patent: Jun. 10, 2014

(54) ROLL PAPER SETTING STRUCTURE

(75) Inventor: Akihisa Iwata, Kanagawa (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

(21) Appl. No.: 13/820,708

(22) PCT Filed: Mar. 11, 2011

(86) PCT No.: PCT/JP2011/056500

§ 371 (c)(1), (2), (4) Date: Mar. 4, 2013

(87) PCT Pub. No.: WO2012/056745

PCT Pub. Date: May 3, 2012

(65) Prior Publication Data

US 2013/0161443 A1 Jun. 27, 2013

(30) Foreign Application Priority Data

Oct. 25, 2010 (JP) ..... 2010-238702

(51) Int. Cl.
*B65H 16/06* (2006.01)

(52) U.S. Cl.
USPC ..... 242/596.1; 242/596.4

(58) Field of Classification Search
USPC ..... 242/578, 578.3, 590, 596.1, 596.4, 242/598.1
See application file for complete search history.

(56) References Cited

U.S. PATENT DOCUMENTS 4,768,039 A * 8/1988 Akutagawa et al. ..... 347/222
5,697,576 A 12/1997 Bloch et al.
6,698,959 B2 * 3/2004 Kaya ..... 400/613
6,824,091 B2 * 11/2004 Inana ..... 242/578.2
7,909,522 B2 * 3/2011 Heaton et al. ..... 400/88
8,047,462 B2 * 11/2011 Yamada ..... 242/578
8,292,213 B2 10/2012 Kobayashi et al.

FOREIGN PATENT DOCUMENTS

| | | | |
|---|---|---|---|
| CN | 1177331 | A | 3/1998 |
| CN | 1443653 | A | 9/2003 |
| CN | 101544136 | A | 9/2009 |
| JP | 6-155841 | A | 6/1994 |
| JP | 6-293451 | A | 10/1994 |
| JP | 2000-351494 | A | 12/2000 |

(Continued)

OTHER PUBLICATIONS

International Search Report for PCT/JP2011/056500 dated May 31, 2011.

(Continued)

*Primary Examiner* — Sang Kim
(74) *Attorney, Agent, or Firm* — Sughrue Mion, PLLC

(57) ABSTRACT

A paper roll setting structure includes a paper roll receiving section (120), a setting shaft structure (130), and a receiving frame (140). The receiving frame (140) includes a shaft position guide (150). The shaft position guide (150) includes a pair of guide pieces (151) and a loading recess (152). The setting shaft structure (130) includes shaft portions (131) so as to rotatably support a paper roll (200). Viewing the positions of the pair of guide pieces (151) enables an operator to recognize the positions of the shaft portions (131). Using the loading recess (152) enables the operator to insert his/her finger in the paper roll receiving section (120) to a deep side (Z2) in a roll loading direction. As a result, the operator can easily and reliably load the roll (200).

1 Claim, 7 Drawing Sheets

(56) References Cited

FOREIGN PATENT DOCUMENTS

| | | | |
|---|---|---|---|
| JP | 2001-253601 | A | 9/2001 |
| JP | 2002-87652 | A | 3/2002 |
| JP | 2005-96433 | A | 4/2005 |
| JP | 2010-36989 | A | 2/2010 |
| JP | 4415353 | B2 | 2/2010 |

OTHER PUBLICATIONS

Office Action, dated Dec. 2, 2013, issued by the State Intellectual Property Office of the People's Republic of China, in counterpart Application No. 201180039301.X.

* cited by examiner

ROLL PAPER SETTING STRUCTURE

CROSS REFERENCE TO RELATED APPLICATIONS

This application is a National Stage of International Application No. PCT/JP2011/056500 filed Mar. 11, 2011, claiming priority based on Japanese Patent Application No. 2010-238702 filed Oct. 25, 2010, the contents of all of which are incorporated herein by reference in their entirety.

TECHNICAL FIELD

This invention relates to a paper roll setting structure for loading a paper roll into equipment having a printer function.

BACKGROUND ART

Conventionally, as a form in which a paper roll is received in equipment, there are known a form in which a shaft member inserted through a core tube of the paper roll is supported by support portions of an apparatus main body formed separately from the shaft member, and a form in which structure for supporting the paper roll is provided to an open/close cover pivotably fixed to the apparatus main body.

However, in the former form, at the time of loading operation of the paper roll, it is necessary to perform at least two steps, that is, a step of inserting the shaft member through the core tube of the paper roll, and a step of fixing the shaft member to the support portions of the apparatus main body, and hence there has been a problem in that operability of the loading operation is poor. Further, in the latter form, the entire apparatus does not have a good weight balance under a state in which the paper roll is fitted to the open/close cover, and hence there has been a problem in that stability of the apparatus is more likely to be degraded at the time of the loading operation of the paper roll.

As a method of achieving both the operability of the loading operation and the stability of the apparatus at the time of the loading operation described above, there is known a method of loading the paper roll into the apparatus main body.

Conventionally, as an apparatus having structure for loading the paper roll, there is known a paper roll retaining apparatus including: a pair of guide members for guiding side surfaces of a paper roll, the pair of guide members respectively including guide surfaces which are arranged to be opposed to each other; retaining members for retaining the paper roll, the retaining members being provided respectively in holes of the pair of guide members; and biasing members each for biasing one of the retaining members toward another one of the retaining members so as to protrude the one of the retaining members from one of the guide surfaces (for example, see Patent Literature 1).

CITATION LIST

Patent Literature 1: Japanese Unexamined Patent Application (JP-A) No. 2010-36989

DISCLOSURE OF THE INVENTION

Problems to be Solved by the Invention

However, in the conventional paper roll retaining apparatus, at the time of the loading operation of the paper roll, the retaining members are out of sight of an operator due to a finger of an operator, the paper roll, and the like, and hence it is difficult for the operator to recognize a positional relationship between the core tube of the paper roll and the retaining members. Thus, there has been a problem in that the operability of the loading operation is degraded.

In addition, depending on arrangement of the retaining members onto the apparatus main body, also before the loading operation of the paper roll (that is, when the paper roll is not loaded), it is sometimes difficult to visually recognize positions of the retaining members. In this case, it has been further difficult to perform the loading operation of the paper roll.

Therefore, this invention has been made in order to solve the conventional problems. That is, it is an object of this invention to provide a paper roll setting structure capable of realizing easy and reliable roll loading operation.

Means to Solve the Problem

In order to solve the above-mentioned problems, according to one embodiment of this invention, there is provided a paper roll setting structure, comprising: an apparatus main body including a paper roll receiving section provided inside the apparatus main body to be open to an outside of the apparatus main body on only a front side of the apparatus main body; a setting shaft structure provided inside the paper roll receiving section, for rotatably supporting a paper roll loaded into the paper roll receiving section; and a receiving frame provided on an opening side of the paper roll receiving section, wherein the receiving frame includes two shaft position guides for guiding a position of an axis of the setting shaft structure, wherein each of the shaft position guides is provided on a near side than the setting shaft structure in a roll loading direction and is spatially away from the setting shaft structure, wherein each of the shaft position guides includes a pair of guide pieces provided to be spaced apart from each other; and a loading recess formed between the pair of guide pieces and recessed toward a deep side in the roll loading direction, wherein each of the shaft position guides is provided on each outer side of the paper roll receiving section and the shaft position guides are remote from each other in an axial direction of the setting shaft structure, wherein each of the loading recesses includes a curved recessed surface obtained by recessing a center region between the pair of guide pieces toward the deep side in the roll loading direction.

In order to solve the above-mentioned problems, according to another embodiment of invention, there is provided a paper roll setting structure, comprising: an apparatus main body including a paper roll receiving section provided inside the apparatus main body to be open to an outside of the apparatus main body on only a front side of the apparatus main body; and a setting shaft structure provided inside the paper roll receiving section, for rotatably supporting a paper roll loaded into the paper roll receiving section, wherein the setting shaft structure includes a pair of shaft portions protruding respectively from both side walls of the paper roll receiving section in an axial direction of the setting shaft structure toward an inside of the paper roll receiving section; a pair of support portions for supporting the pair of shaft portions, respectively; and biasing member for biasing the pair of support portions toward the inside of the paper roll receiving section, wherein each of the pair of shaft portions is set to have an outer diameter smaller than an inner diameter of a core tube of the paper roll, wherein each of the pair of support portions includes a core tube contact surface that is held in contact only with a side end surface of the core tube when the paper roll is supported by the pair of shaft portions; a near-side inclined surface provided on a near side than the core tube contact surface in the roll loading direction and extending toward a deep side in the roll loading direction so as to be inclined toward the paper roll receiving section; and a deep-side inclined surface provided on the deep side than the core tube contact surface in the roll loading direction and extending toward the near side in the roll loading direction so as to be inclined toward the paper roll receiving section, wherein each of the pair of shaft portions includes a first inclined surface provided on the near side of the shaft portions in the roll loading direction and extending toward the deep side in the roll loading direction so as to be inclined toward the paper roll receiving section; and a second inclined surface provided on the deep side of the shaft portions in the roll loading direction and extending toward the near side in the roll loading direction so as to be inclined toward the paper roll receiving section.

Effect of the Invention

According to this invention, the pair of guide pieces is provided on the receiving frame, and thus even in a case where it is difficult to visually recognize the position of the axis of the setting shaft structure from the outside of the apparatus main body before loading the paper roll and at the time of the loading operation of the paper roll, an operator can visually recognize the position of the axis of the setting shaft structure using the pair of guide pieces as a guide. Further, the loading recess is formed between the pair of guide pieces, and thus the operator can insert, to the deep side in the roll loading direction, his/her fingers that hold the paper roll. Therefore, easy and reliable loading operation of the paper roll can be realized.

Further, even if the guide pieces and the loading recess are not visible due to a place and the like for installing the apparatus, the operator senses the loading recess by a sense of finger touch, and thus can recognize the position of the axis. Therefore, reliability of the loading operation can be further improved.

BEST MODE FOR EMBODYING THE INVENTION

In the following, an electronic apparatus 100 according to an embodiment of this invention is described with reference to the drawings.

Embodiment

The electronic apparatus 100 according to this invention is an electronic apparatus having a printer function, such as a point of sale (POS) system and a ticketing device.

Figure 1:
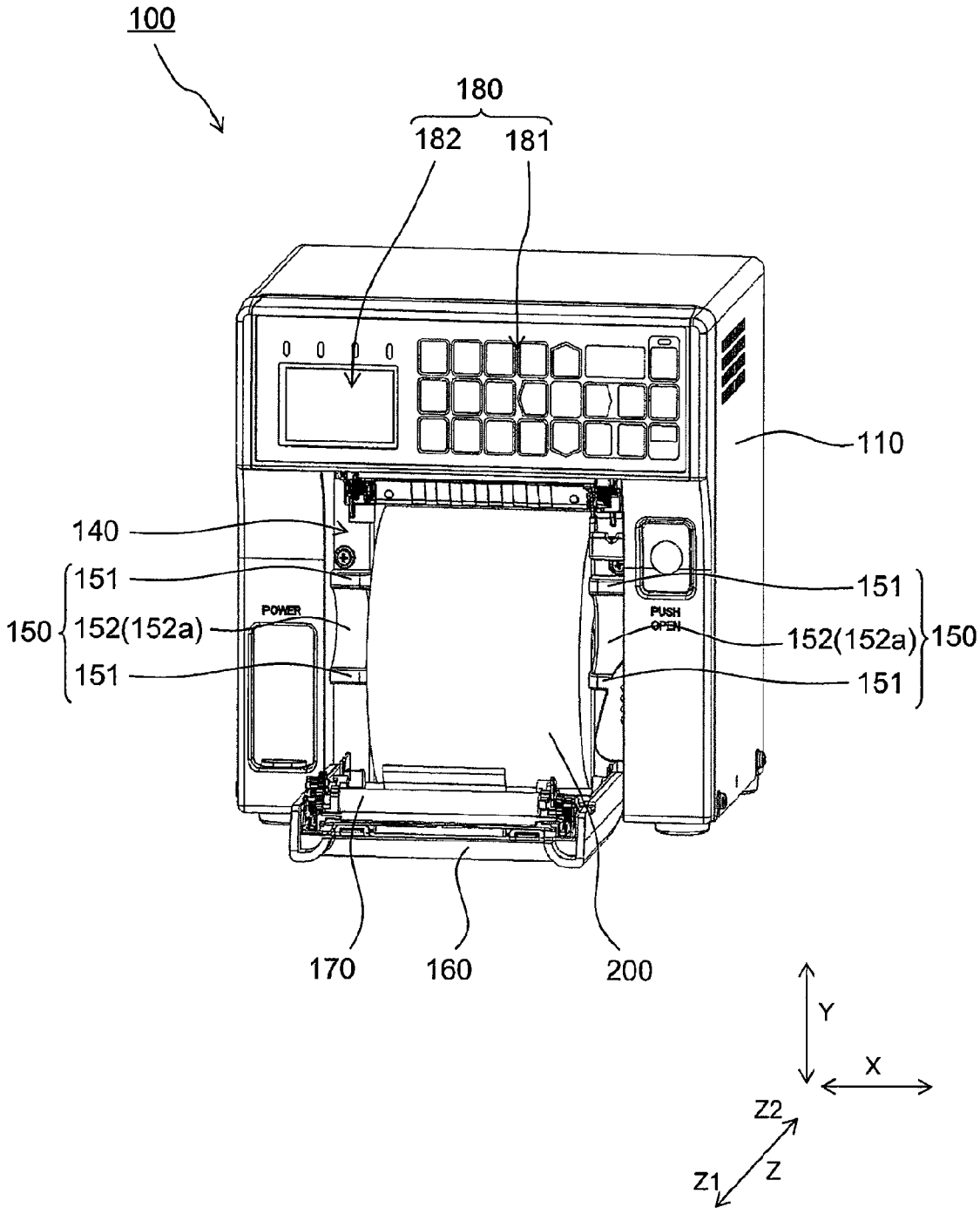
FIG. 1 is a perspective view illustrating a state in which a paper roll is loaded into an electronic apparatus according to an embodiment of this invention.
Figure 2:
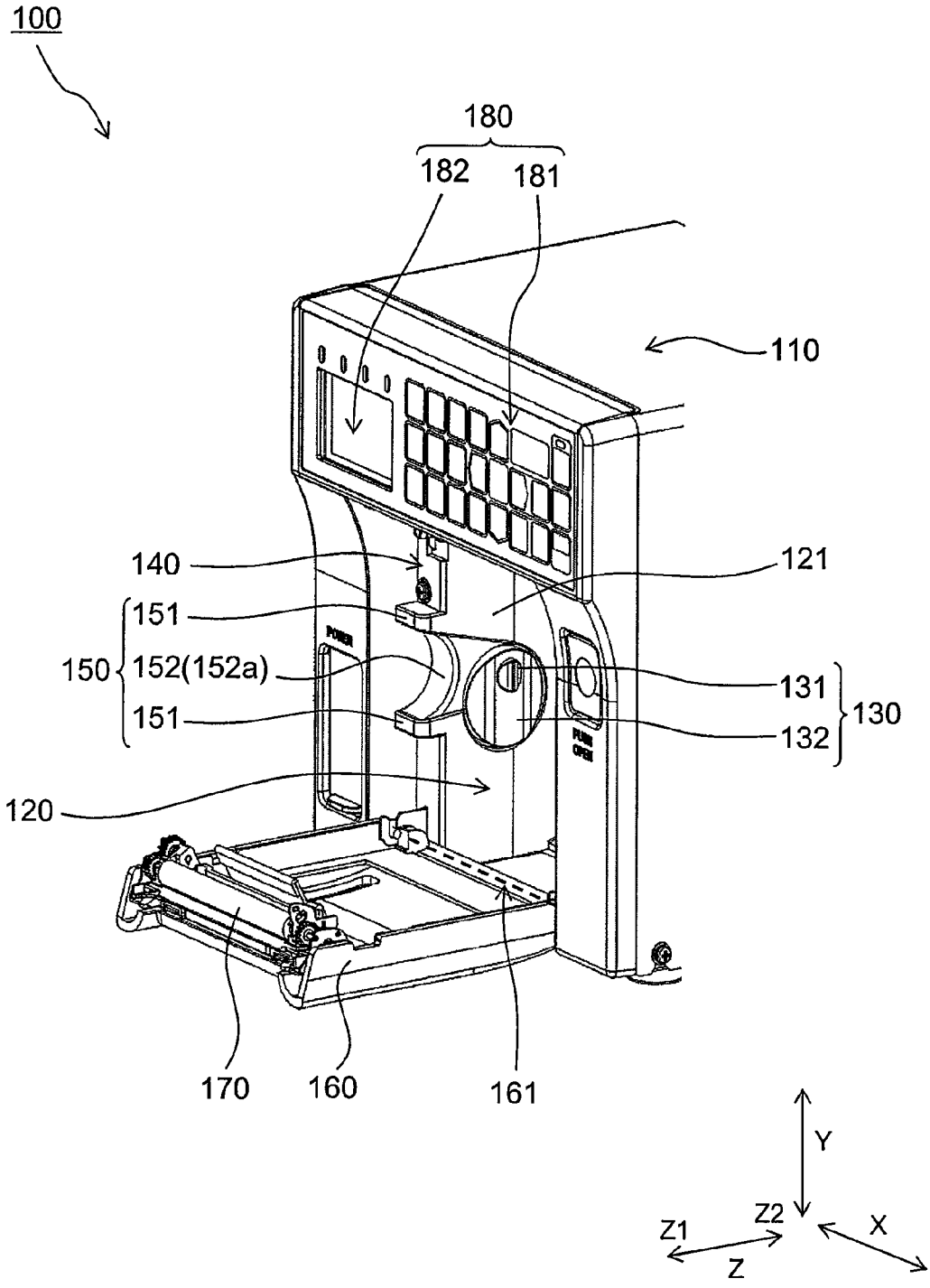
FIG. 2 is a perspective view illustrating a state in which the paper roll is not loaded into the electronic apparatus.
Figure 3:
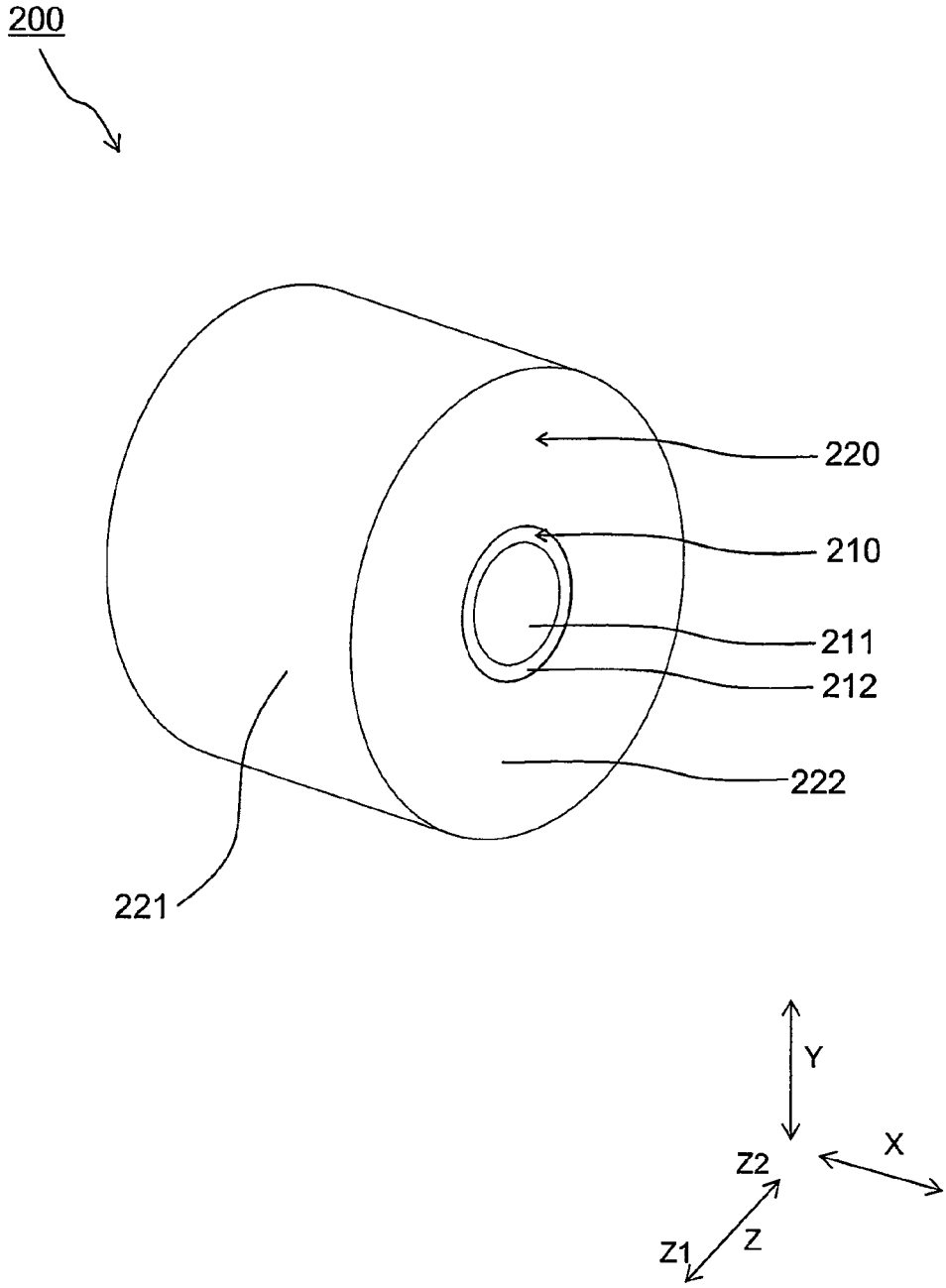
FIG. 3 is a perspective view illustrating the paper roll.

As illustrated in FIGS. 1 and 2, the electronic apparatus 100 includes an apparatus main body 110, and an open/close cover 160 fixed to the apparatus main body 110 so as to be pivotable, for covering a paper roll receiving section 120 of the apparatus main body 110 so as to freely open and close the paper roll receiving section 120.

As illustrated in FIG. 2, etc., the apparatus main body 110 includes: the paper roll receiving section 120 for receiving a paper roll 200, the paper roll receiving section 120 being provided inside the apparatus main body 110 to be open to an outside of the apparatus main body on a front side of the apparatus main body 110; a setting shaft structure 130 provided integrally with the apparatus main body 110, for rotatably supporting the paper roll 200 loaded into the paper roll receiving section 120; a receiving frame 140 provided on an opening side of the paper roll receiving section 120; input/output means 180 provided on an outer surface of the apparatus main body 110 on the front side; a printing head (not shown) provided inside the apparatus main body 110, for performing printing on a paper surface of the paper roll 200; various electronic components (not shown); and the like.

Figure 5:
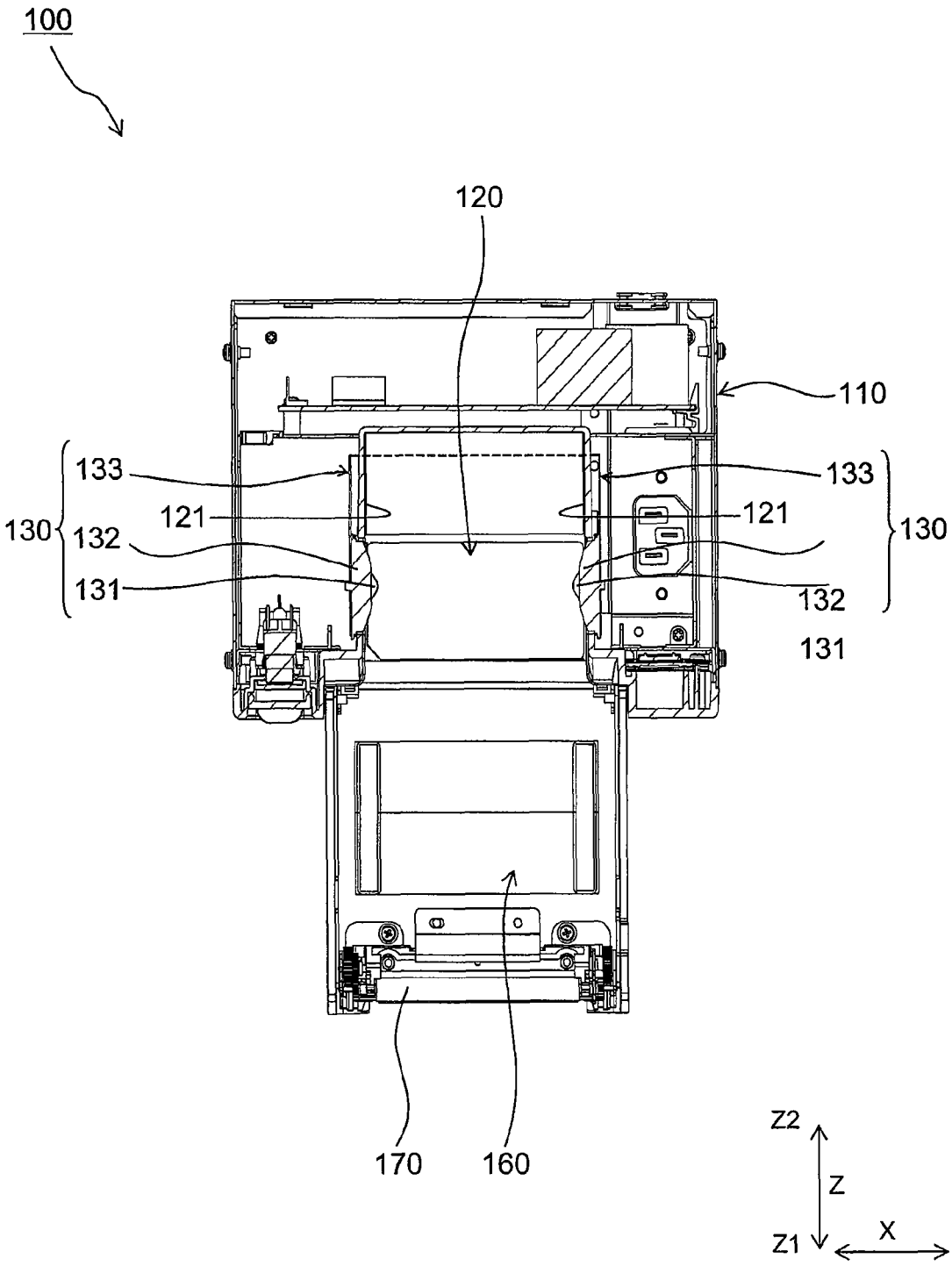
FIG. 5 is a cross-sectional view taken along the line A-A of FIG. 4, for illustrating the electronic apparatus viewed from the arrow "A" direction of FIG. 4.

As illustrated in FIGS. 2 and 5, the setting shaft structure 130 includes: a pair of shaft portions 131 for rotatably supporting the paper roll 200; a pair of support portions 132 for supporting the shaft portions 131, respectively; and a biasing spring (biasing member) 133 for biasing the support portions 132 toward an inside of the paper roll receiving section 120.

As illustrated in FIG. 2, etc., when the paper roll 200 is received, the shaft portions 131 are engaged with an inner peripheral surface 211 of a core tube 210 of the paper roll 200, and slightly protrude respectively from both side walls 121 of the paper roll receiving section 120 in an axial direction X toward the inside of the paper roll receiving section 120. Note that, both the side walls 121 of the paper roll receiving section 120 function to guide the paper roll 200 at the time of loading operation of the paper roll 200.

Figure 6:
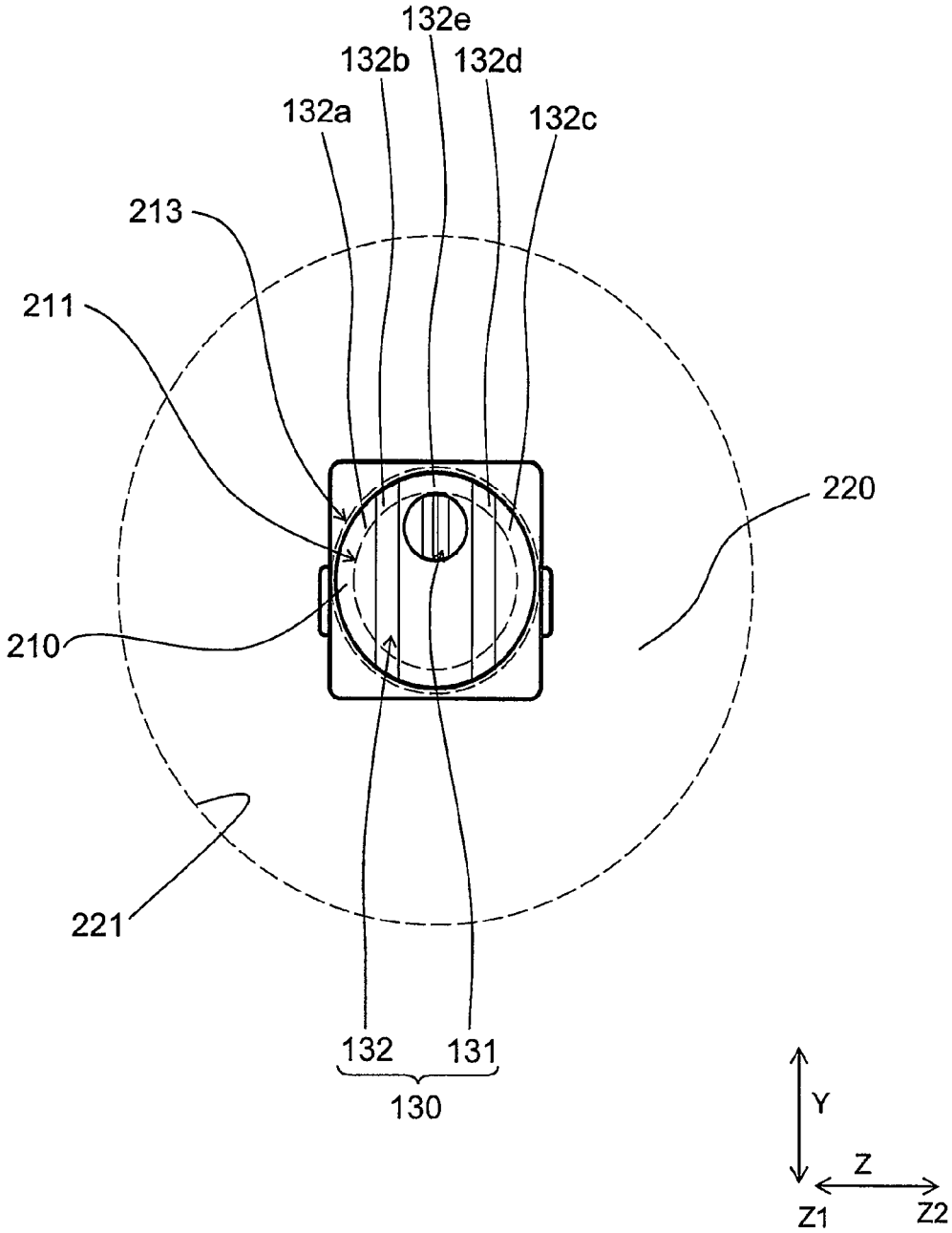
FIG. 6 is an explanatory diagram illustrating a state in which the paper roll is fitted to a setting shaft structure.

As illustrated in FIG. 6, the shaft portions 131 are each designed to have an outer diameter smaller than an inner diameter of the core tube 210 (that is, diameter of the inner peripheral surface 211).

Figure 4:
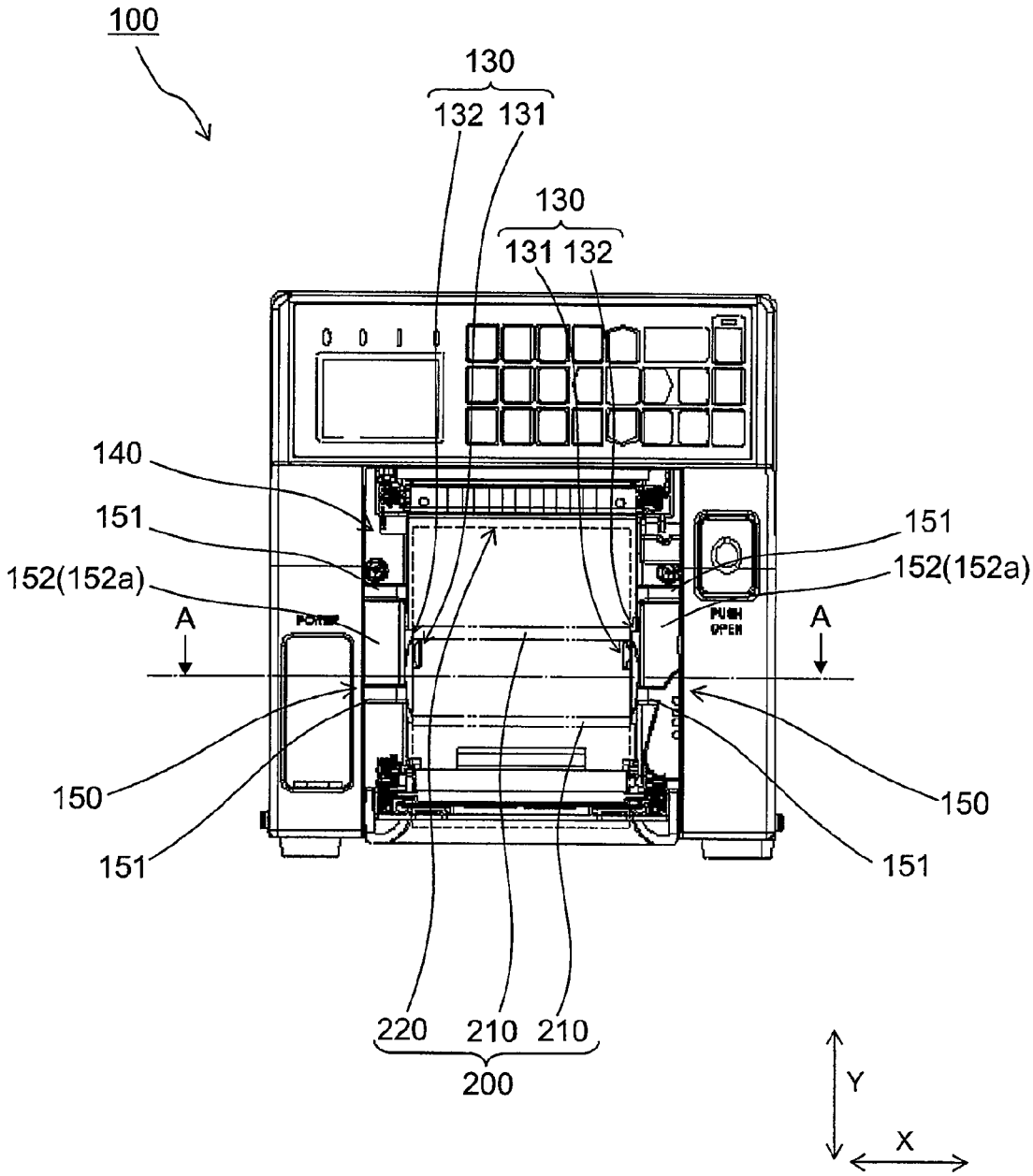
FIG. 4 is a plan view illustrating the electronic apparatus viewed from a front side thereof.

Note that, as illustrated in FIG. 4, etc., the shaft portions 131 protrude toward the inside of the paper roll receiving section 120 by a slight amount, and are arranged on a deep side Z2 in a roll loading direction Z with respect to the receiving frame 140. Accordingly, the shaft portions 131 are not easily visible from an outside of the electronic apparatus 100.

Further, in this embodiment, the paper roll receiving section 120 is open to the front side of the apparatus main body 110. Thus, in a case where an operator sees the paper roll receiving section 120 from an obliquely upper side thereof, an upper part of the apparatus main body 110 provided on the upper side of the paper roll receiving section 120 (specifically, as illustrated in FIG. 1, upper part of the apparatus main body 110 in which a display panel 182 and an input button group 181 are provided) hinders visibility of the shaft portions 131, and hence it is further difficult to visually recognize positions of the shaft portions 131 from the outside of the apparatus main body.

Figure 7:
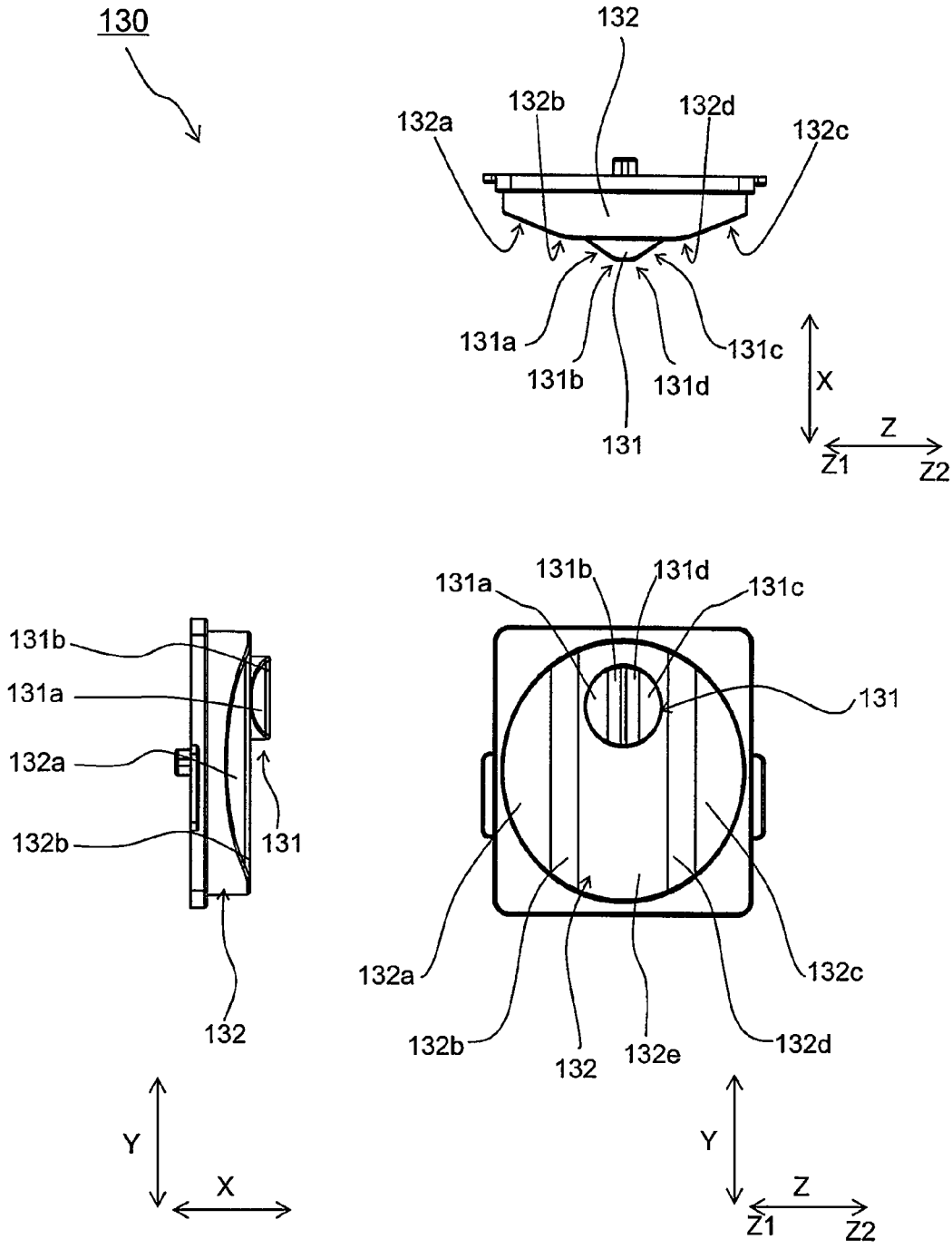
FIG. 7 shows a front view, a top view, and a side view illustrating the setting shaft structure.

As illustrated in FIG. 7, each of the shaft portions 131 includes: a near-side inclined surface 131*a* and a near-side inclined surface 131*b* provided on a near side Z1 in the roll loading direction Z and extending toward the deep side Z2 in the roll loading direction Z so as to be inclined toward the paper roll receiving section 120; and a deep-side inclined surface 131*c* and a deep-side inclined surface 131*d* provided on the deep side Z2 in the roll loading direction Z and extending toward the near side Z1 in the roll loading direction Z so as to be inclined toward the paper roll receiving section 120.

As illustrated in FIG. 7, the near-side inclined surface 131*b* is arranged on the deep side Z2 in the roll loading direction Z with respect to the near-side inclined surface 131*a*. The near-side inclined surface 131*b* is set to have a smaller inclination angle with respect to the roll loading direction Z than an inclination angle of the near-side inclined surface 131*a* with respect to the roll loading direction Z.

As illustrated in FIG. 7, the deep-side inclined surface 131*d* is arranged on the near side Z1 in the roll loading direction Z with respect to the deep-side inclined surface 131*c*. The deep-side inclined surface 131*d* is set to have a smaller inclination angle with respect to the roll loading direction Z than an inclination angle of the deep-side inclined surface 131*c* with respect to the roll loading direction Z.

As illustrated in FIG. 5, etc., the support portions 132 are fixed to both the side walls 121 of the paper roll receiving section 120, respectively, so as to be capable of shifting along the axial direction X. Further, the support portions 132 are biased toward the inside of the paper roll receiving section 120 by the biasing spring (biasing member) 133 fixed to the apparatus main body 110.

When the paper roll 200 is received, the support portions 132 biased by the biasing spring (biasing member) 133 are held in contact only with side end surfaces 212 of the core tube 210, respectively, to thereby restrain movement of the paper roll 200 in the axial direction X. Note that, in this embodiment, as illustrated in FIG. 5, as the biasing member 133, a plate spring having a C-shaped cross-section is adopted, but any means such as a coil spring and an elastic rubber may be adopted as long as the biasing member 133 biases the support portions 132.

As illustrated in FIG. 7, each of the support portions 132 includes: a near-side inclined surface 132*a* and a near-side inclined surface 132*b* provided on the near side Z1 in the roll loading direction Z and extending toward the deep side Z2 in the roll loading direction Z so as to be inclined toward the paper roll receiving section 120; a deep-side inclined surface 132*c* and a deep-side inclined surface 132*d* provided on the deep side Z2 in the roll loading direction Z and extending toward the near side Z1 in the roll loading direction Z so as to be inclined toward the paper roll receiving section 120; and a flat surface 132*e* provided in a center region in the roll loading direction Z and arranged in parallel to a plane defined by a roll height direction Y and the roll loading direction Z.

As illustrated in FIG. 7, the near-side inclined surface 132*b* is arranged on the deep side Z2 in the roll loading direction Z with respect to the near-side inclined surface 132*a*. The near-side inclined surface 132*b* is set to have a smaller inclination angle with respect to the roll loading direction Z than an inclination angle of the near-side inclined surface 132*a* with respect to the roll loading direction Z.

As illustrated in FIG. 7, the deep-side inclined surface 132*d* is arranged on the near side Z1 in the roll loading direction Z with respect to the deep-side inclined surface 132*c*. The deep-side inclined surface 132*d* is set to have a smaller inclination angle with respect to the roll loading direction Z than an inclination angle of the deep-side inclined surface 132*c* with respect to the roll loading direction Z.

As illustrated in FIG. 6, when the paper roll 200 is received, the flat surface 132*e* functions as a core tube contact surface that is held in contact only with each side end surface 212 of the core tube 210 (that is, not held in contact with each side end surface 222 of a paper portion 220 of the paper roll 200).

In other words, as illustrated in FIG. 6, each of the shaft portions 131 is provided on each of the support portions 132 so that the flat surface 132*e*, the near-side inclined surface 132*b*, and the deep-side inclined surface 132*d* are situated on the inner side of an outer peripheral surface 213 of the core tube 210 under a state in which the paper roll 200 is supported by the shaft portions 131. Note that, reference numeral 221 illustrated in FIG. 6 denotes an outer peripheral surface of the paper portion 220.

As illustrated in FIG. 1, etc., the receiving frame 140 includes a shaft position guide 150 provided on each side surface of the receiving frame 140 on the near side Z1 in the roll loading direction Z, for guiding a position of each of the shaft portions 131.

As illustrated in FIGS. 2 and 4, the shaft position guide 150 is formed at a position close to the setting shaft structure 130 in the roll height direction Y orthogonal to the axial direction X and the roll loading direction Z, and at a position at which the shaft position guide 150 is visible from the outside of the apparatus main body at the time of the loading operation of the paper roll 200 (specifically, at the time of opening the open/close cover 160 as illustrated in FIG. 1).

As illustrated in FIG. 1, etc., the shaft position guide 150 is provided on each outer side of the paper roll receiving section 120 in the axial direction X.

The shaft position guide 150 includes: a pair of guide pieces 151 provided to be spaced apart from each other in the roll height direction Y; and a loading recess 152 formed between the pair of guide pieces 151 and recessed toward the deep side Z2 in the roll loading direction Z.

As illustrated in FIG. 2, etc., the guide pieces 151 are formed to protrude from the receiving frame 140 toward the near side Z1 in the roll loading direction Z.

As illustrated in FIG. 4, etc., a center region between the pair of guide pieces 151 in the roll height direction Y (that is, center region of the loading recess 152 in the roll height direction Y) is situated above the positions of the shaft portions 131 in the roll height direction Y.

As illustrated in FIG. 1, etc., the loading recess 152 includes a curved recessed surface 152*a* obtained by recessing the center region between the pair of guide pieces 151 in the roll height direction Y toward the deep side Z2 in the roll loading direction Z.

As illustrated in FIG. 2, the open/close cover 160 is fixed to the apparatus main body 110 so as to be pivotable about a pivot shaft 161.

As illustrated in FIGS. 1 and 2, a platen roller 170 for drawing out the paper roll 200 is fixed to the open/close cover 160.

As illustrated in FIGS. 1 and 2, the input/output means 180 includes the display panel 182 and the input button group 181.

According to the electronic apparatus 100 of this invention obtained in the above-mentioned manner, even in a case where it is difficult to visually recognize the positions of the shaft portions 131 from the outside of the apparatus main body before loading the paper roll 200 and at the time of the loading operation, the guide pieces 151 formed at two upper and lower positions in the roll height direction Y enable an operator to visually recognize the positions of the shaft portions 131, and hence the loading operation of the paper roll 200 can be easily achieved.

The loading recess 152 is formed between the pair of guide pieces 151. Accordingly, using the loading recess 152, an operator can insert his/her fingers further to the deep side Z2 in the roll loading direction Z, and the operator can hold the paper roll 200 until the shaft portions 131 are engaged with the core tube 210. Therefore, more reliable loading operation of the paper roll 200 can be realized.

Even if the guide pieces 151 and the loading recess 152 are not visible due to a place and the like for installing the electronic apparatus 100, an operator senses the loading recess 152 by a sense of finger touch, and thus can recognize the position of each of the shaft portions 131. Therefore, reliability of the loading operation can be further improved.

The guide pieces 151 are formed at two positions, that is, upper and lower positions, in the roll height direction Y and two positions, that is, right and left positions, in the axial direction X, that is, formed at four positions in total. Accordingly, at the time of the loading operation, even in a case where the guide pieces 151 are partially out of sight of an operator due to a finger of the operator or the paper roll 200, or the guide pieces 151 are partially out of sight of the operator due to a relative positional relationship between the electronic apparatus 100 and the operator, a situation in which all of the guide pieces 151 are not visible is easily avoided. Therefore, it is possible to improve operability at the time of the loading operation of the paper roll 200.

The loading recess 152 includes the curved recessed surface 152*a*, and hence the center region between the pair of guide pieces 151 in the roll height direction Y (that is, center region of the curved recessed surface 152*a* in the roll height direction Y) can be visually recognized easily. In addition, in a case where a finger of an operator touches the curved recessed surface 152*a*, the curved recessed surface 152*a* guides the finger of the operator to the center region of the curved recessed surface 152*a* in the roll height direction Y, and thus the operator can adjust a position of the core tube 210 in the roll height direction Y with respect to the position of each of the shaft portions 131 in the roll height direction Y. Therefore, more reliable loading operation of the paper roll 200 can be realized.

Each of the support portions 132 includes the core tube contact surface (flat surface 132*e*) that is held in contact only with the side end surface 212 of the core tube 210 when the shaft portions 131 and the core tube 210 are engaged with each other. Accordingly, reliable retention of the paper roll 200 can be realized without a necessity for a strong biasing force exerted by the biasing spring 133. Further, the core tube contact surface is not held in contact with the side end surface 222 of the paper portion 220 of the paper roll 200, and hence can be prevented from damaging the paper roll 200. Still further, frictional resistance between each of the support portions 132 and the paper roll 200 at the time of rotation of the paper roll 200 is reduced, and hence smooth conveyance of a printed sheet of paper can be realized.

Each of the shaft portions 131 includes the near-side inclined surface 131*a* and the near-side inclined surface 131*b*, and each of the support portions 132 includes the near-side inclined surface 132*a* and the near-side inclined surface 132*b*. Accordingly, at the time of the loading operation of the paper roll 200, against the biasing force of the biasing spring 133, the shaft portions 131 and the support portions 132 are smoothly pushed by the paper roll 200 outward in the axial direction X, and hence satisfactory loading of the paper roll 200 can be realized.

Each of the shaft portions 131 includes the deep-side inclined surface 131*c* and the deep-side inclined surface 131*d*, and each of the support portions 132 includes the deep-side inclined surface 132*c* and the deep-side inclined surface 132*d*. Accordingly, at the time of removing the paper roll 200 from the paper roll receiving section 120, against the biasing force of the biasing spring 133, the shaft portions 131 and the support portions 132 are smoothly pushed by the paper roll 200 outward in the axial direction X, and hence satisfactory removing operation of the paper roll 200 can be realized.

Further, in general, when an operator holds the paper roll 200 by holding the side end surfaces of the paper roll 200, the operator holds an upper side of the paper roll 200 in the roll height direction Y with respect to an axis of the paper roll 200.

Therefore, according to this invention, the center region between the pair of guide pieces 151 in the roll height direction Y is situated above the position of each of the shaft portions 131 in the roll height direction Y. With this configuration, a positional relationship in the roll height direction Y between the shaft portions 131 and the core tube 210 at the time of the loading operation is adjusted, and more reliable loading operation of the paper roll 200 is realized.

This application claims priority on the basis of Japanese Patent Application No. 2010-238702, filed on Oct. 25, 2010, the entire disclosure of which is incorporated herein by reference.

REFERENCE SIGNS LIST

100 . . . electronic apparatus
110 . . . apparatus main body
120 . . . paper roll receiving section
121 . . . side wall
130 . . . setting shaft structure
131 . . . shaft portion
131*a* . . . near-side inclined surface
131*b* . . . near-side inclined surface
131*c* . . . deep-side inclined surface
131*d* . . . deep-side inclined surface
132 . . . support portion
132*a* . . . near-side inclined surface
132*b* . . . near-side inclined surface
132*c* . . . deep-side inclined surface
132*d* . . . deep-side inclined surface
132*e* . . . flat surface (core tube contact surface)
133 . . . biasing spring (biasing member)
140 . . . receiving frame
150 . . . shaft position guide
151 . . . guide piece
152 . . . loading recess
152*a* . . . curved recessed surface
160 . . . open/close cover
161 . . . pivot shaft
170 . . . platen roller
180 . . . input/output means
181 . . . input button group
182 . . . display panel
200 . . . paper roll
210 . . . core tube
211 . . . inner peripheral surface of core tube
212 . . . side end surface of core tube
213 . . . outer peripheral surface of core tube
220 . . . paper portion
221 . . . outer peripheral surface of paper portion
222 . . . side end surface of paper portion
X . . . axial direction
Y . . . roll height direction
Z . . . roll loading direction
Z1 . . . near side in roll loading direction
Z2 . . . deep side in roll loading direction

The invention claimed is:

1. A paper roll setting structure, comprising:

an apparatus main body including a paper roll receiving section provided inside the apparatus main body to be open to an outside of the apparatus main body on only a front side of the apparatus main body; and a setting shaft structure provided inside the paper roll receiving section, for rotatably supporting a paper roll loaded into the paper roll receiving section, wherein the setting shaft structure includes a pair of shaft portions protruding respectively from both side walls of the paper roll receiving section in an axial direction of the setting shaft structure toward an inside of the paper roll receiving section; a pair of support portions for supporting the pair of shaft portions, respectively; and biasing member for biasing the pair of support portions toward the inside of the paper roll receiving section, wherein each of the pair of shaft portions is set to have an outer diameter smaller than an inner diameter of a core tube of the paper roll, wherein each of the pair of support portions includes a core tube contact surface that is held in contact only with a side end surface of the core tube when the paper roll is supported by the pair of shaft portions;

a near-side inclined surface provided in front of the core tube contact surface in the roll loading direction and extending toward a deep side of the pair of support portions, opposite the front side of the pair of support portions in the roll loading direction so as to be inclined toward the paper roll receiving section; and a deep-side inclined surface provided in the deep side of the core tube contact surface, opposite the front side of the core tube contact surface in the roll loading direction and extending toward the front side in the roll loading direction so as to be inclined toward the paper roll receiving section, wherein each of the pair of shaft portions includes a first inclined surface provided front of the shaft portions in the roll loading direction and extending toward the deep side of the setting shaft structure, opposite the front side of the setting shaft structure in the roll loading direction so as to be inclined toward the paper roll receiving section; and a second inclined surface provided on the deep side of the shaft portions, opposite the front side of the shaft portions in the roll loading direction and extending toward the front side in the roll loading direction so as to be inclined toward the paper roll receiving section.

* * * * *